United States Patent [19]

Nogi et al.

[11] Patent Number: 4,865,006

[45] Date of Patent: Sep. 12, 1989

[54] LIQUID ATOMIZER

[75] Inventors: Toshiharu Nogi, Hitachi; Teruo Yamauchi; Yoshishige Oyama, both of Katsuta, all of Japan

[73] Assignee: Hitachi, Ltd., Tokyo, Japan

[21] Appl. No.: 169,450

[22] Filed: Mar. 17, 1988

[30] Foreign Application Priority Data

Mar. 20, 1987 [JP] Japan ..... 62-63986

[51] Int. Cl.[4] ..... F02M 29/00

[52] U.S. Cl. ..... 123/590; 123/478; 261/81; 261/DIG. 48

[58] Field of Search ..... 123/590, 472, 478, 490; 261/DIG. 48, 81

[56] References Cited

U.S. PATENT DOCUMENTS

| | | | |
|---|---|---|---|
| 4,563,993 | 1/1986 | Yamauchi et al. | 123/478 |
| 4,576,136 | 3/1986 | Yamauchi et al. | 123/590 |
| 4,590,915 | 5/1986 | Yamauchi et al. | 123/590 |
| 4,665,877 | 5/1987 | Manaka et al. | 123/472 |
| 4,703,743 | 11/1987 | Takayama | 123/590 |
| 4,715,353 | 12/1987 | Koike et al. | 123/590 |
| 4,716,879 | 1/1988 | Takayama et al. | 123/590 |
| 4,742,810 | 5/1988 | Anders et al. | 123/590 |

FOREIGN PATENT DOCUMENTS 60-11224 3/1985 Japan .

*Primary Examiner*—E. Rollins Cross

*Attorney, Agent, or Firm*—Antonelli, Terry & Wands

[57] ABSTRACT

A liquid atomizer utilizes a plurality of laminated piezoelectric elements for converting electrical oscillation into mechanical vibration, a circuit for generating resonance frequency of a low DC voltage, the circuit being electrically connected to the piezoelectric elements and including a charging circuit for forcibly causing electric charge based on said DC resonance frequency voltage to flow from a DC power source into the laminated piezoelectric elements and a discharge circuit for forcibly causing electric charge stored in the laminated piezoelectric elements to be discharged.

10 Claims, 9 Drawing Sheets

LIQUID ATOMIZER

BACKGROUND OF THE INVENTION

This invention relates to a liquid atomizer in which electrical oscillation applied to piezoelectric elements is converted into mechanical vibration, and a variety of liquids such as liquid fuels are atomized by utilizing the mechanical vibration.

Various devices have heretofore been proposed to atomize liquid using vibration of piezoelectric elements. In the field of fuel injection devices for internal combustion engines, for instance, liquid fuel is injected onto a vibrator of a hollow cylindrical member that is vibrated by a piezoelectric element. The fuel is atomized by the ultrasonic vibration of the vibrator in order to promote the atomization of fuel injected from a fuel injection valve, as is disclosed in Japanese Pat. Publication No. 11224/1985 and U.S. Pat. No. 4,563,993.

Piezoelectric elements used for liquid atomizers of this type deform to cause displacement therein when a voltage is applied thereto. The displacement, however, is as small as about 0.1 micron when a voltage of 100 volts is applied. Where only a pair of piezoelectric elements only are used as in the above-mentioned prior art, therefore, it is not possible to obtain a sufficiently large vibration. It has therefore been attempted to apply a large voltage (usually 200 volts or higher) to the piezoelectric elements or to provide the piezoelectric element with a mechanical vibration amplifying means such as a horn to amplify the mechanical vibration, thereby to take out mechanical vibration of a desired amplitude and to transmit the thus amplified mechanical vibration to the vibrator.

To atomize liquid using a vibrator of a hollow cylindrical member, a sufficient amount of displacement is imparted to the hollow cylindrical member. To obtain the displacement of such a degree, so far, a voltage of about 200 volts has been applied to the piezoelectric elements and the displacement has been amplified by a tapered horn.

According to the conventional liquid atomizer which makes use of the piezoelectric element as described above, a relatively large voltage is applied to the piezoelectric element and a mechanical vibration amplifying means such as a horn is used to amplify the displacement that is to be transmitted to the vibrator. For this purpose, means for increasing the voltage must be incorporated in the circuit which drives the piezoelectric element and a member such as a horn must be used, resulting in an increase in the manufacturing cost and in the size of the whole device.

SUMMARY OF THE INVENTION

The present invention was accomplished in view of the above-mentioned circumstances and its object is to provide a device which generates mechanical vibration to a sufficient degree to atomize liquid by applying a low DC voltage to the piezoelectric elements without using mechanical vibration amplifying means such as a horn.

The present invention is based on the fact that a mechanical vibration is obtained that is proportional to the number of laminates if a so-called lamination type piezoelectric element, in which a lot of piezoelectric elements are laminated in many layers, is used. The laminated piezoelectric element is driven by an electrical oscillation generated by means for generating resonance frequency of a low DC voltage so that it can be driven with a low DC voltage source such as a storage battery without converting the DC voltage into a high voltage and without mechanical vibration amplifying means such as a horn. The means for generating a low DC resonance frequency voltage comprises a charging circuit which forcibly causes the electric charge based upon the resonance frequency voltage to flow from a DC power source into the laminated piezoelectric element, and a discharging circuit which forcibly causes the electric charge stored in the laminated piezoelectric element to be discharged.

BRIEF DESCRIPTION OF THE DRAWINGS

FIG. 11(*b*) is a sectional view of FIG. 11(*a*);

FIG. 11(*c*) is a plan view of FIG. 11(*a*), which is partially broken;

DETAILED DESCRIPTION OF THE INVENTION

First, properties of the laminated piezoelectric element will be explained.

A piezoelectric element deforms to produce displacement when a voltage is applied thereon. A piezoelectric element has displacement of about 0.1 micron caused when a voltage of 100 V is applied although the displacement value changes depending on a size thereof and other factors.

The displacement increases if the piezoelectric elements are laminated, i.e., increases in proportion to the lamination number. For example, the displacement of about 10 microns will be obtained if a voltage of 100 volts is applied to the element which consists of 100 laminas each of which is such as above mentioned. To vibrate a vibrator such as hollow cylindrical member to such an extent that the liquid which is in contact with the vibrator can be atomized, it is necessary to impart displacement of about 0.6 microns to the vibrator. Here, however, when a voltage of 12 V is applied to 50 piezoelectric elements that are laminated, the displacement will be $500\times0.1\times(12/100)=1.2$ microns. Therefore, the hollow cylindrical member can be vibrated to atomize the liquid without using a horn which amplifies the displacement.

According to the present invention, DC electric oscillation (resonance frequency voltage) is given to the laminated piezoelectric elements to cause mechanical vibration. To apply such a voltage, a charging circuit draws an electric charge (charge current) based upon the resonance frequency voltage from a DC power source and permits it to flow into the laminated piezoelectric elements. Then, a discharging circuit forcibly causes the electric charge stored in the laminated piezoelectric elements to be discharged. By repeating the charge and discharge, a resonance frequency voltage is applied to the laminated piezoelectric elements. The electric charge is forcibly charged and discharged because of the reasons described below. That is, the voltage applied to the laminated piezoelectric elements is a DC resonance frequency voltage. However, since the laminated piezoelectric elements consist of many layers and have a large capacity, simple application of a voltage requires an extended period of time for effecting the charging and discharging. Therefore, the electric charge is forcibly charged and discharged to quicken the operation and to quicken the response of mechanical vibration of the laminated piezoelectric element.

According to the present invention, therefore, the laminated piezoelectric elements are driven by a relatively low DC voltage so that they generate mechanical vibration which is sufficient for atomizing the liquid, and the mechanical vibration is transmitted to the vibrator to atomize the liquid.

Next, an embodiment of the invention will be described hereunder referring to FIGS. 1 to 5.

Figure 1A:
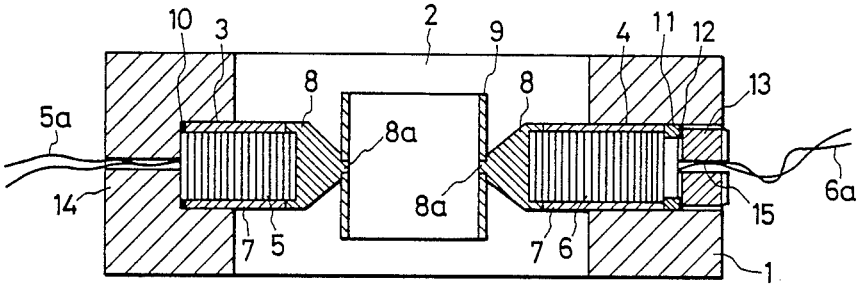
FIG. 1*a* is a sectional view, taken along a line I*a*–I*a* of FIG. 1*b*, of an embodiment of a mechanical part of a liquid atomizer according to the present invention.
Figure 1B:
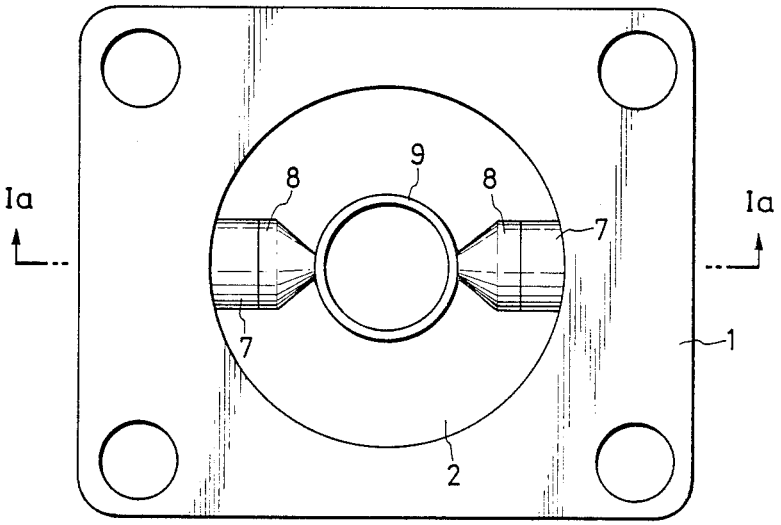
FIG. 1*b* is a plan view of FIG. 1*a;*
Figure 2:
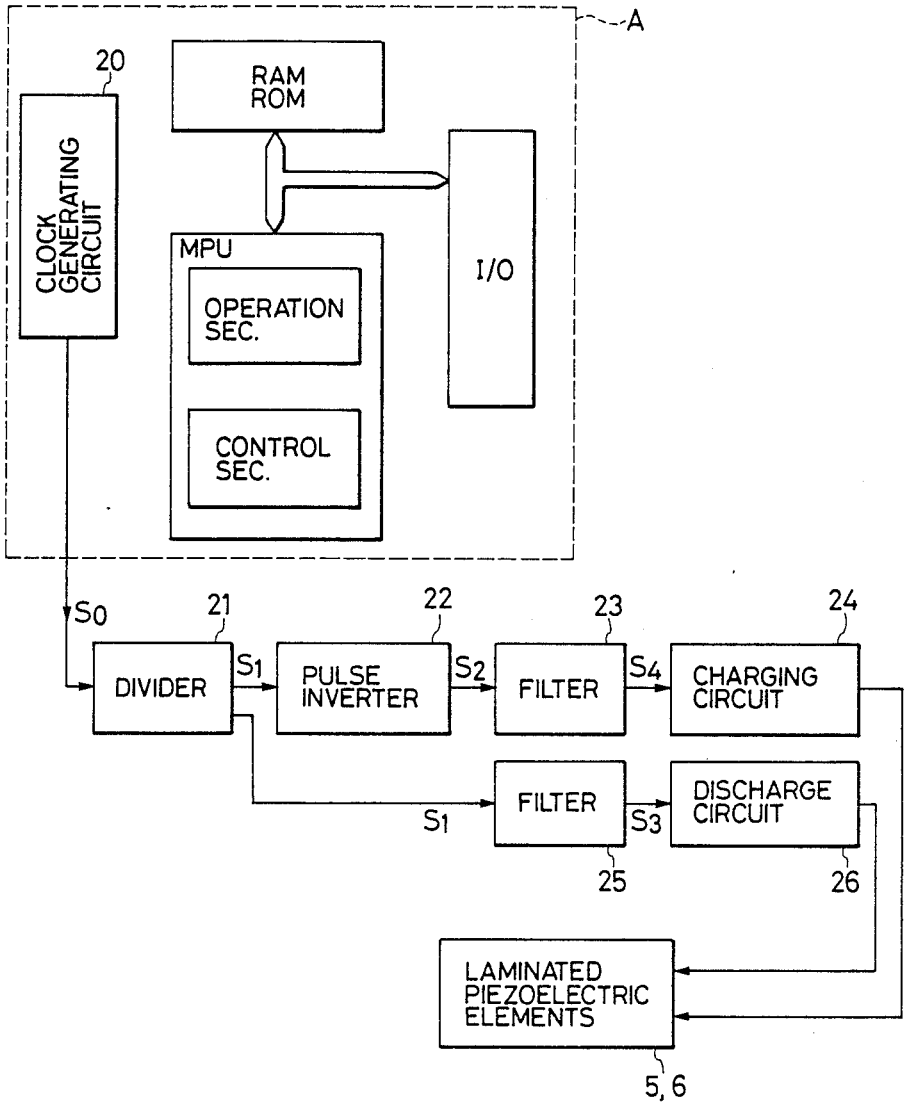
FIG. 2 is a diagram illustrating an embodiment of an electrical circuit for driving laminated piezoelectric elements according to the present invention.

In FIGS. 1 and 2 illustrating a mechanical part of a liquid atomizer according to an embodiment of the present invention, a block 1 incorporates therein mechanical parts of the liquid atomizer. An annular space 2 is formed in the center of the block 1 to accommodate a tubular member 9 and a member 8 that supports the tubular member 9. On both the right and left sides of the block 1, holes 3 and 4 for holding piezoelectric elements are formed so as to face each other and in a direction crossing the center line of the space 2 at right angle. The hole 3 is not punched through but the hole 4 is punched through to facilitate the operation for assembling a pair of laminated piezoelectric elements 5 and 6 as transducers.

The laminated piezoelectric elements 5 and 6 are formed by laminating many piezoelectric laminas so as to provide a columnar shape as a whole. An outer periphery thereof is coated with an insulating resin material 7 having resistance against gasoline and an end thereof is provided with the support member 8 that is narrowed toward the tip thereof. The laminated piezoelectric elements 5 and 6 each are held with their support members 8 being directed toward the central axis of the space 2. When held, the pair of support members 8 support the tubular member 9.

The tubular member 9 is arranged concentric with the space 2 and vibrates upon receipt of mechanical vibration from the laminated piezoelectric elements 5 and 6 via the support members 8.

Described below is how to mount the laminated piezoelectric elements 5 and 6, the support members 8, and the tubular member 9. First, the rear end of the laminated piezoelectric element 5 is inserted in the hole 3 of the block 1 via a packing 10, the tubular member 9 is set concentric with the space 2, and a protrusion **8*a* at the tip of support member 8 on the side of the piezoelectric element 5 is brought into engagement with a small hole formed in the side surface of the tubular member 9. Then, the laminated piezoelectric element 6 is inserted in the through hole 4 from the outside, and a protrusion 8*a* at the tip of support member 8 is brought into engagement with a small hole formed in the side surface of the tubular member 9. Thereafter, the laminated piezoelectric element 6 is fastened by a bolt 13 via spacer 11 and packing 12. Electrode/lead wires 5*a* and 6*a* of the laminated piezoelectric elements 5 and 6 are taken out of the block through a hole 14 formed in the block 1 and a hole 15 formed in the bolt 13. Owing to the above-mentioned mounting construction, the tubular member 9, the support members 8, and the laminated piezoelectric elements 5 and 6 are firmly held together as a unitary structure. A voltage of a DC sine wave (resonance frequency voltage) that will be described later is applied in same phase to the laminated piezoelectric elements 5 and 6 via electrodes 5*a* and 6*a*, so that displacement, that is, mechanical vibration takes place in the elements 5, 6. The vibration is then transmitted to the tubular member 9 via support members 8. Tips of the support members 8 are narrowed to support the tubular member 9. Therefore, vibration of the member 9 is not impaired. The protrusion 8*a* at the tip of the support member 8 has a diameter which is shorter than a distance between nodes in a vibration mode that the tubular member 1** is resonating.

Figure 3:
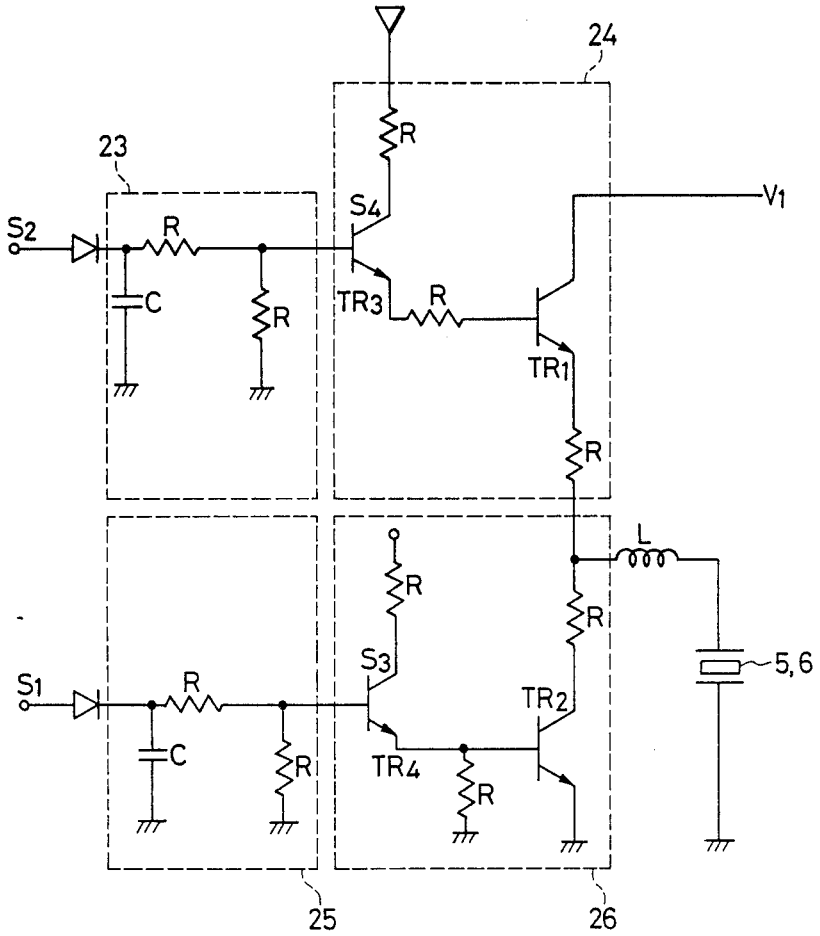
FIG. 3 is a concrete circuit diagram illustrating a major portion of the embodiment.

Described below is a circuit for driving the laminated piezoelectric elements 5 and 6 in conjunction with FIGS. 2 and 3. FIG. 2 is a block diagram illustrating a circuit for driving the laminated piezoelectric elements, and FIG. 3 is a circuit diagram which illustrates a concrete example.

Figure 5:
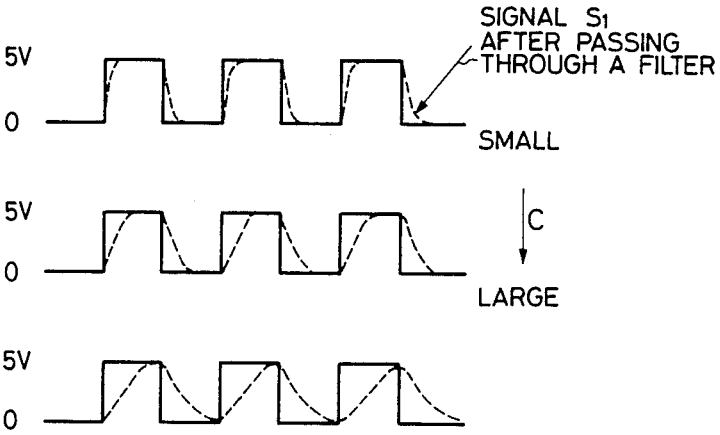

In FIG. 2, reference numeral 20 denotes a clock generating circuit of an automobile engine control unit (microcomputer) A, and 21 denotes a frequency dividing circuit which divides clock signals $S_0$ (usually, about 1 MHz) of the clock generating circuit 20 into pulses $S_1$ of about 30 KHz. The signals $S_1$ have a pulse waveform of a voltage of 0 to 5 volts. The signals $S_1$ on one side are inverted by a pulse inverter circuit 22 to form signals $S_2$. The signals $S_1$ on the other side are directly sent to a filter 25. The pulse signals $S_1$ and $S_2$ pass through filter circuits 25 and 23 to form sine wave signals $S_3$ and $S_4$ having voltage levels of 0 to 5 volts. The signal $S_3$ operates a discharging circuit 26 and the signal $S_4$ operates a charging circuit 24. Here, reference should be made to FIGS. **4*a* and 4*b* which show clock signals $S_0$ and pulse signals $S_1$, $S_2$ which are divided into a signal $S_1$, and signal $S_3$ and $S_4$ for the charging circuit 24 and the discharging circuit 26, respectively, and FIG. 5 which shows signals $S_1$ (or $S_2$) when they pass through the filter circuit 25 (or 23). The pulse waveform can be brought close to sine waveform by increasing the capacity C of the filter circuits 25 and 23 as shown in FIG. 5**.

Upon receipt of the sine wave signal $S_4$, the charging circuit 24 forcibly causes a low-voltage current (electric charge) proportional to the signal $S_4$ to flow from the storage battery (DC power supply) that is not shown into the laminated piezoelectric elements 5 and 6. On the other hand, upon receipt of the sine wave signal $S_3$ of a phase opposite to the signal $S_4$, the discharging circuit 26 forcibly causes the electric charge stored in the laminated piezoelectric elements 5 and 6 to be discharged. By repeating the above-mentioned charging and discharging operation, a DC resonance frequency voltage is applied to the laminated piezoelectric elements 5 and 6. The charging and discharging operations are forcibly effected for the laminated piezoelectric elements 5 and 6 as mentioned above because of the following reasons. That is, since each laminated piezoelectric element consists of as many as 50 layers, for example, the capacity is about 50 times as great as that of a piece of piezoelectric element, and an extended period of time is required for charging or discharging the electric charge thereby causing the displacement response to be delayed. Therefore, the charging circuit and the discharging circuit are provided to quicken the displacement response characteristics.

By applying a voltage in a manner as described above, the laminated piezoelectric elements 5 and 6 produce mechanical vibration.

FIG. 3 illustrates a concrete structure of a circuit for driving the laminated piezoelectric elements. Filter circuits 23 and 25 consist of a CR circuit to convert a pulse wave $S_1$ (discharge signal) and a pulse wave $S_2$ (charge signal) into DC sine wave signals $S_3$ and $S_4$. A charging circuit 24 comprises a transistor $Tr_3$ that amplifies the charge signal $S_4$ of a sine waveform and a power transistor $Tr_1$ that is operated by the amplified signal $S_4$. A discharging circuit 26 comprises a transistor $Tr_4$ that amplifies the discharge signal $S_3$ of a sine waveform and a power transistor $Tr_2$ that is operated by the amplified signal $S_3$.

Figure 4A:
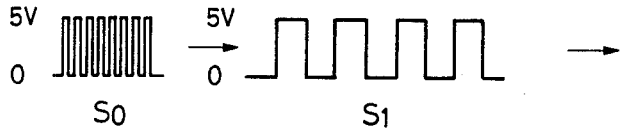
FIGS. 4*a*, 4*b* and 5 are diagrams of signal waveforms for explaining the operation of the embodiment.
Figure 4B:
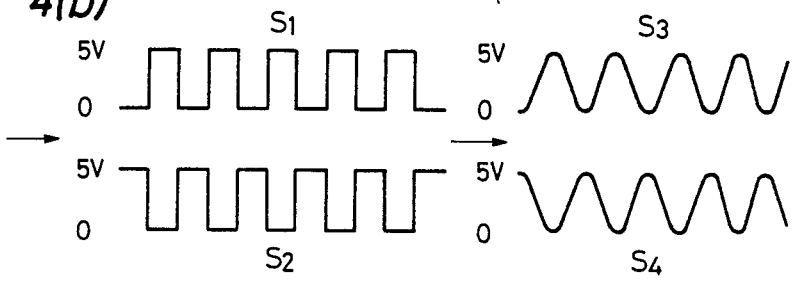

Here, the charge signal $S_4$ and the discharge signal $S_3$ of sine waveforms have phases opposite to each other as shown in FIG. 4*b*, and the power transistors TR1 and $TR_2$ are turned on and off alternately. That is, when the charge signal $S_4$ is input, the power transistor $TR_1$ of the charging circuit 24 is turned on, and a relatively large charge current flows into the laminated piezoelectric elements 5 and 6 at a low voltage (12 volts) such that a positive voltage $V_1$ is applied thereto. Further, when the discharge signal $S_3$ is input, the power transistor $TR_2$ of the discharging circuit 26 is turned on, and the electric charge stored in the laminated piezoelectric elements 5 and 6 are forcibly discharged as a discharge current. The charge and discharge currents that flow into the transistors $TR_1$ and $TR_2$ are sine waveforms depending upon the signals $S_4$ and $S_3$. Therefore, DC voltage of sine waveforms are applied to the laminated piezoelectric elements 5 and 6. When the laminated piezoelectric elements 5 and 6 are driven on a low voltage, an electric current of several amperes (50 times as great as the current that flows into a piece of piezoelectric element) flows, and the transistors $TR_1$ and $TR_2$ must have a capacity that permits the flow of current of several amperes. Further, since pulses of a period of 30 KHz are applied, the transistors $TR_1$ and $TR_2$ must have a response speed which is faster than 30 $\mu$s.

As described above, a voltage of a sine wave is applied to the laminated piezoelectric elements 5 and 6 so that they will produce mechanical vibration. The mechanical vibration is then transmitted to the tubular member 9 via the support members 8 as shown in FIG. 1. In this case, the embodiment of the invention presents advantages as described below.

First, as previously described, the piezoelectric elements are laminated so that the displacement increases in proportion to the number of laminas. Therefore, the laminated piezoelectric element generates mechanical vibration to a degree sufficient for atomizing the liquid without the need of using a mechanical vibration amplifying member such as a horn. That is, to obtain vibration to a degree to atomize the liquid using the tubular member 9, displacement of about 0.6 microns, for example is imparted to the tubular member. According to this embodiment, mechanical displacement of about 0.6 microns can be obtained by applying a voltage of 12 volts to the laminated piezoelectric element which consists of 50 laminas.

Figure 6A:
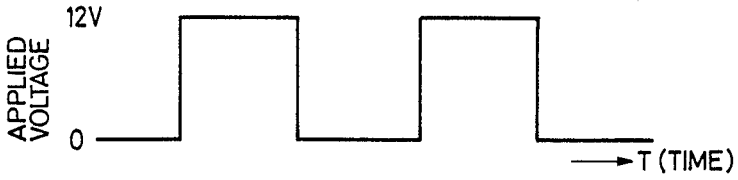
FIGS. 6(*a*), 6(*b*), 7(*a*) and 7(*b*) are diagrams of characteristics showing relationships between the voltage applied to the piezoelectric element and displacement thereof.
Figure 6B:
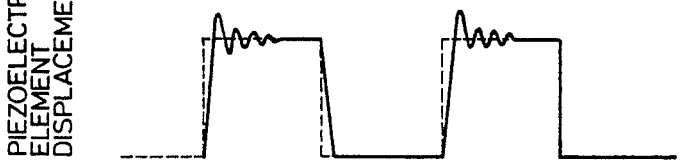

Second, a voltage of a sine waveform is applied to the laminated piezoelectric elements 5 and 6 through the charging circuit and the discharging circuit to quicken the response speed. When the laminated piezoelectric elements are driven by a voltage of a sine waveform, in this case, better mechanical vibration is obtained than when they are driven by a voltage of a square waveform such as rectangular pulses. The reasons will be described in conjunction with FIGS. 6(*a*), 6(*b*) and 7(*a*), 7(*b*). FIGS. 6(*a*) and 6(*b*) illustrate the change of voltage and the displacement of the piezoelectric element with the lapse of time when a rectangular pulse-like voltage is applied to the laminated piezoelectric element. When rectangular pulses are applied as shown in FIG. 6(*a*), displacement of the piezoelectric element fails to acquire a perfect pulse-like form as shown in FIG. 6(*b*) but displacement of high-frequency components is superposed thereon. This is because, the waveform of pulse can be expressed by synthesizing (fourier transform) a variety of sine waveforms and, hence, contains frequency components that are higher than a frequency at which the piezoelectric elements are to be driven. Therefore, even when the elements are driven at 30 KHz, it can be said that they are also driven at such frequencies as 60 KHz and 120 KHz. Hence, the efficiency becomes poor and high-frequency components are superposed on the displacement of the piezoelectric elements.

Figure 7A:
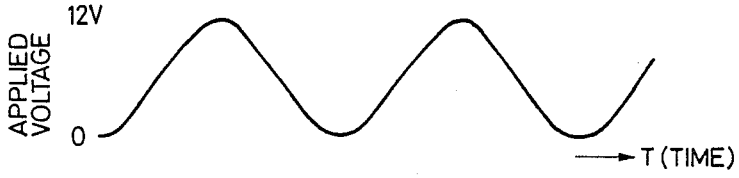
Figure 7B:
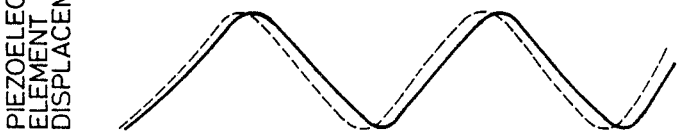

On the other hand, when a voltage of a sine waveform is applied to the laminated piezoelectric element as shown in FIG. 7(*a*), no frequency component is contained but the one at which the elements are to be driven. Therefore, displacement, represented by a solid line, of the piezoelectric element follows the applied voltage, represented by a dotted line, as shown in FIG. 7(*b*). Here, the phase deviates slightly between the applied voltage and the displacement depending upon the capacity of a capacitor of the filter circuit and the capacity of a capacitor of the laminated piezoelectric element. Here, however, no problem arises when the piezoelectric elements are driven continuously.

Figure 8:
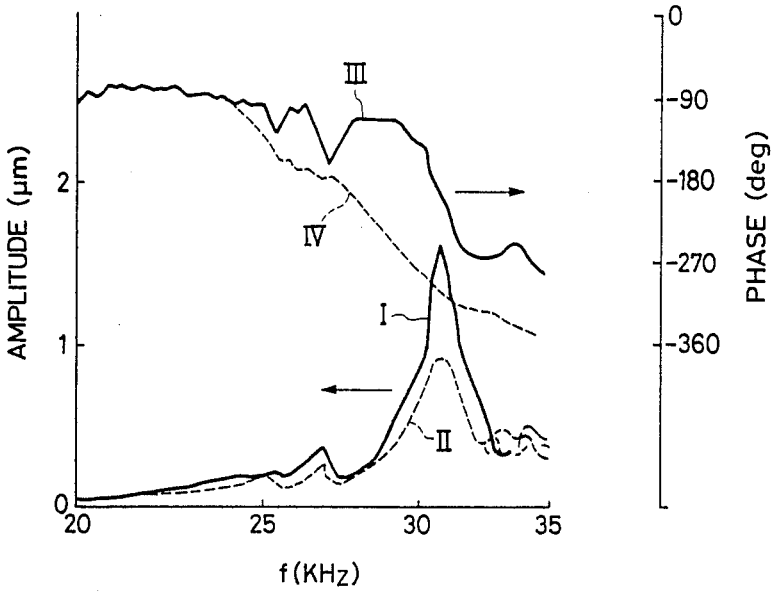
FIG. 8 is a diagram of characteristics showing relationships among the frequency of voltage applied to the laminated piezoelectric element, the amplitude and the phase.

FIG. 8 illustrates a relationship among the drive frequency f, displacement (amplitude) of the tubular member 9 and phase when a rectangular pulse-like voltage and a voltage of a sine waveform are applied to the laminated piezoelectric element, wherein a solid line represents a voltage of the sine waveform and a dotted line represents a rectangular pulse-like voltage. As will be obvious from the comparison of the lines I and II, resonance takes place in the displacement of the laminated piezoelectric element at a frequency of 30 KHz, so that the displacement increases. When the input power is the same, the sine waveform produces a larger displacement than the pulses. The phase starts to be delayed later when the sine wave is applied than when the pulses are applied, as shown by III, IV. This is because, when the pulses are applied, high-frequency components generate displacement as described earlier.

Figure 9:
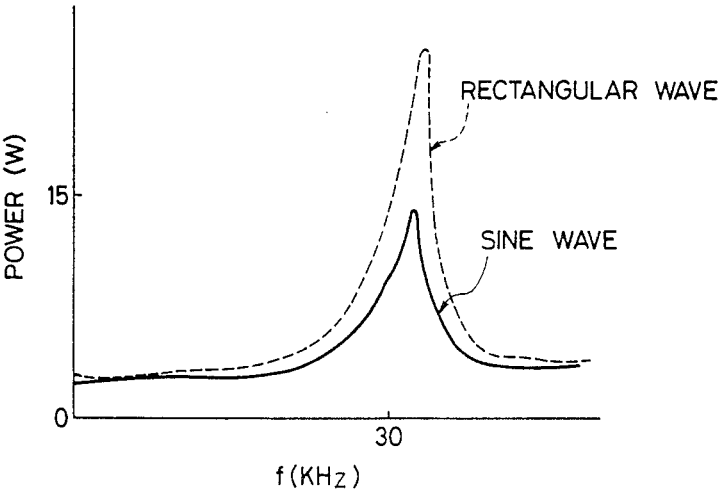
FIG. 9 is a diagram of characteristics showing relationships between the frequency and the electric power applied to the laminated piezoelectric element.

FIG. 9 illustrates a relationship between the drive frequency f of the applied voltage and the input power. The electric power increases at around 30 KHz due to resonance. It will be recognized that the input power is small and the efficiency is high when a sine waveform is employed. That is, to obtain the same displacement, smaller electric power is required when the elements are driven with the sine waveform than when they are driven with the pulses.

Third, according to this embodiment, a pair of laminated piezoelectric elements 5 and 6 are symmetrically arranged on the right and left sides at right angles with the axis of the tubular member 9, and displacements of the same phase are transmitted to the tubular member via the support members 8 to vibrate it. Therefore, the device exhibits excellent mechanical vibration transmission characteristics, and the tubular member 9 works as an optimum device for atomizing a liquid using vibration.

Figure 10A:
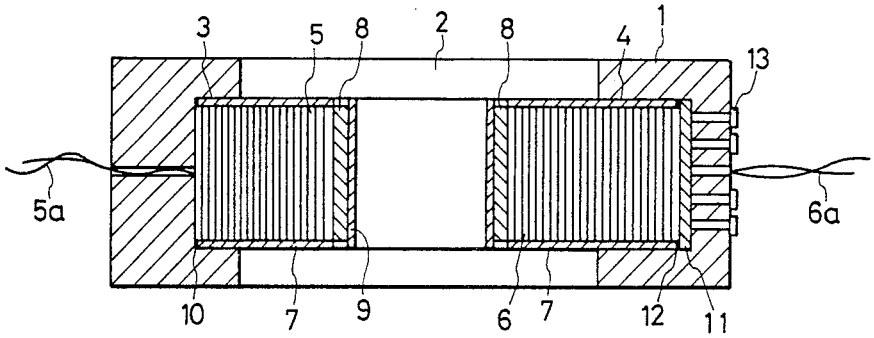
FIG. 10*a* is a sectional view, taken along a line of X*a*–X*a* in FIG. 10*b*, of another embodiment of a mechanical part of the liquid atomizer according to the present invention.
Figure 10B:
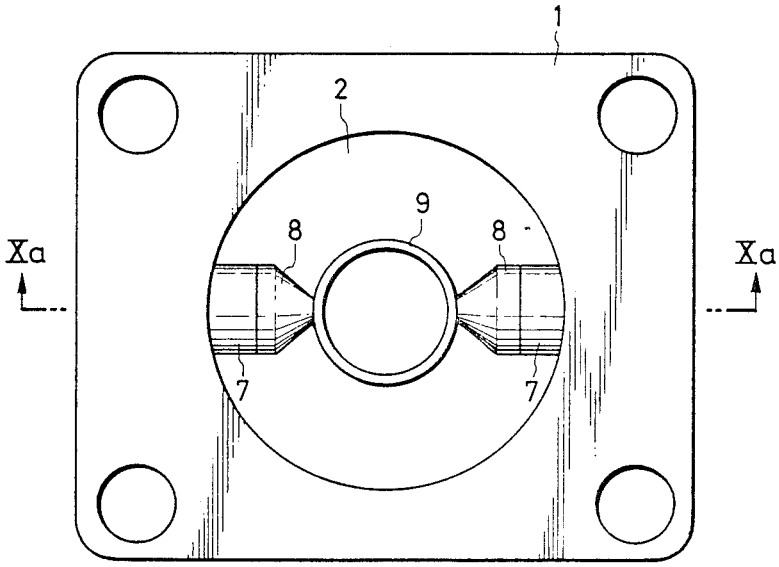
FIG. 10*b* is a plan view of FIG. 10*a;*

FIG. 10 illustrates another embodiment of the present invention and wherein the same reference numerals as those of the aforementioned embodiment denote the same or corresponding portions. The liquid atomizer of this embodiment also has mechanical parts; i.e., support members 8 for supporting tubular member 9 have the shape of a triangular pole that is narrowed toward the end, and portions of the support members 8 that come into contact with the outer peripheral surface of the tubular member 9 have nearly the same length as the entire length of the member 9. Furthermore, the length of the laminated piezoelectric elements 5 and 6 in the vertical direction is nearly the same as the length of the tubular member 9. This embodiment is suited for the case where a liquid is to be atomized in large amounts. That is, the liquid can be effectively atomized in large amounts when the vibrating area is increased. For this purpose, the tubular member must have an increased length. According to the method shown in FIG. 1, however, the tubular member having a length which is larger than the diameter is vibrated. Therefore, the displacement is not uniformly transmitted in the lengthwise direction, and the vibration transmission efficiency decreases. To improve this, use is made of support member 8 and laminated piezoelectric elements 5 and 6 that have the same length as the tubular member 9. According to this structure, the same displacement can be given at any point in the lengthwise direction of the tubular member 1, making it possible to vibrate even such a tubular member that has a length relatively greater than the diameter thereof.

Figure 11A:
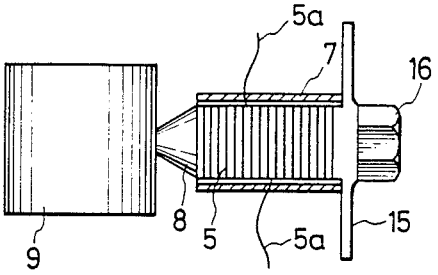
FIG. 11(*a*) is a front view, a part of which is broken, of further another embodiment of a liquid atomizer according to the present invention.
Figure 11C:
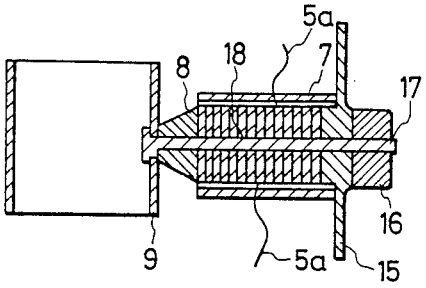
Figure 11B:
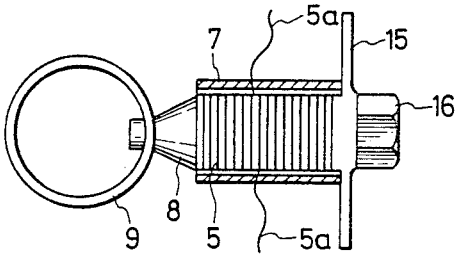

FIGS. 11(*a*), 11(*b*) and 11(*c*) illustrate a further embodiment of the present invention, and wherein FIGS. 11(*a*) and 11(*b*) are a front view and a plan view which illustrate mechanical elements of the liquid atomizer omitting part of the insulating resin 7 for easy explanation, and FIG. 11(*c*) is a vertical section view thereof. The same reference numerals as those of the aforementioned first and second embodiments denote the same or corresponding portions.

In this embodiment, use is made of a single laminated piezoelectric element 5, the tubular member 9 is provided at an end of the laminated piezoelectric element 5 via support member 8, and a flange 15 for mounting the liquid atomizer is provided at the other end. To assemble these members, a bolt insertion hole 18 is formed in the center of each of the laminated piezoelectric element, support member 8 and flange 15 as shown in FIG. 11(*c*), a bolt 17 is inserted in the bolt insertion hole 18 from the inside of the tubular member 9 and is fastened with a nut 16 on the side of the flange 15. Thus, the tubular member 9, support member 8, laminated piezoelectric element 5 and flange 15 are constituted as a unitary structure.

According to this embodiment, the tubular member 9, support member 8 and laminated piezoelectric element 5 are tightly held together by the fastening force of the bolt 17 and nut 16, and the displacement of the laminated piezoelectric element 5 is efficiently transmitted to the tubular member 9.

Figure 12:
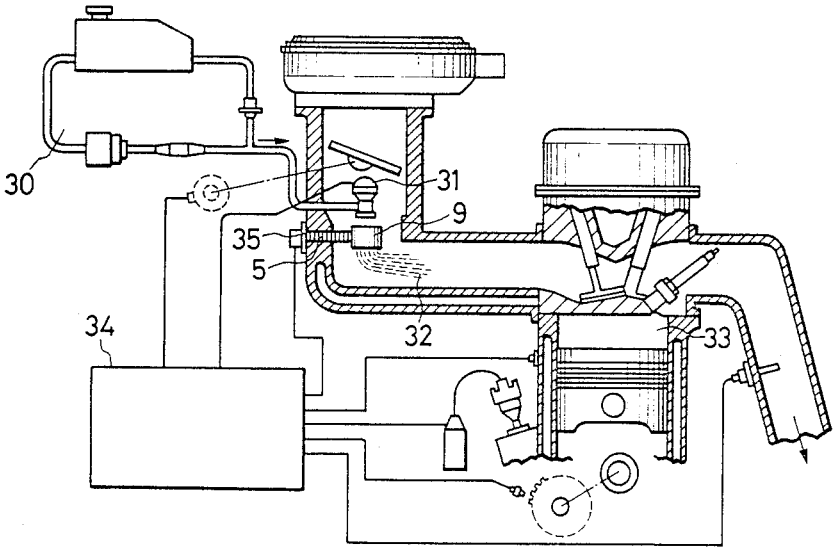
FIG. 12 is a sectional view of an engine system wherein the present invention is applied.

FIG. 12 illustrates the structure of the liquid atomizer of the present invention adapted to an atomized fuel supply apparatus of a gasoline engine of an automobile, wherein reference numeral 30 denotes a fuel supply system, 31 denotes a fuel injection valve provided in an intake path 32 reference numeral 33 denotes a cylinder of the engine, and 34 denotes an engine control unit.

Reference numeral 35 denotes a mechanical part of the liquid atomizer consisting of the laminated piezoelectric element 5, tubular member 9, and the like. The mechanical part of this embodiment is of the same type as that of the last mentioned embodiment as shown in FIG. 11, and in which the tubular member 9 is disposed on an immediately downstream side of the fuel injection valve 31. With the above-mentioned structure, the fuel radially injected from the fuel injection valve 31 comes into contact with the inner peripheral surface of the tubular member 9 and is atomized. Atomization promotes the mixing of the air and the fuel that flow through the intake pipe 32, and a homogeneous mixture is obtained. The homogeneous mixture helps stabilize the combustion in the cylinder 33, making it possible to extend the combustion limit in a lean region to an air-fuel ratio of about 25. Further, since the atomized fuel is carried together with the air stream, the fuel reaches the cylinder within a reduced period of time and transient performance of the engine is improved.

Figure 13:
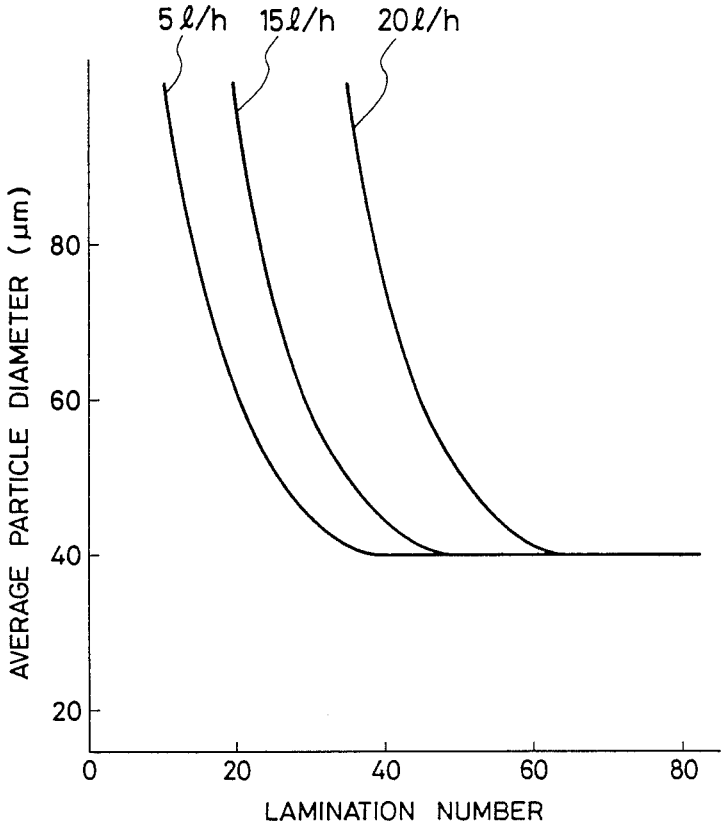
FIG. 13 is a diagram illustrating relationship between an average particle diameter and the lamination number of piezoelectric elements.

FIG. 13 illustrates relationship between average diameters of atomized liquid particles and the lamination number of the piezoelectric elements in a liquid atomizer such as illustrated in FIGS. 1 and 2, wherein the lamination number is one at one side of a tubular member vibrator driven of two sides. The piezoelectric elements of which the length is 10 mm are employed, and 14 V is applied as a low DC voltage. It is noted from the figure that as the lamination number of the piezoelectric elements increases, the average diameter becomes small, because the vibration amplitude increase as the lamination number of a vibrator increases, under a constant voltage of 14 V, so that liquid is easy to atomize. When a liquid flow rate increases from 5 1/h to 20 1/h, the average diameter becomes large under the same lamination number. In order to atomize the liquid of 20 1/h or more to be 60 μm average particle diameter or less, 60 laminas are necessary. Further, under the flow rate $Q_f$ of 5 1/h or less, the atomization characteristic are substantially the same as in the curve of 5 1/h.

Therefore, at least 20 laminas is necessary at one side of the tubular member, or total 40 laminas.

When the liquid atomizer is employed in a fuel supply apparatus as shown in FIG. 12, fuel supply of a maximum flow rate to the engine takes place at acceleration, and the flow rate is about 15 l/h in a class of engine with a capacity of 2 l. In such an engine, 30 laminas is necessary at one side, or total 50 laminas.

The liquid atomizer according to the present invention can be adapted to an automobile fuel injection system either when each cylinder is provided with the fuel injection valve (MPI system) or when the fuel injection valve is provided at a portion where the intake pipes are collected together (SPI system).

According to the present invention as described above, a liquid can be atomized by driving the piezoelectric element only relying upon a low DC voltage power source, for example, of 14 V, to 6 V, such as from a storage battery, without using mechanical vibration amplifying means such as a horn. Owing to the above-mentioned effects, furthermore, a liquid atomizer can be realized which is powered by a simple DC storage battery, making it possible to reduce the size of the mechanical parts and presenting advantages in the manufacturing cost and easiness for equipping ease.

We claim:

1. A liquid atomizer which imparts vibration energy to a liquid to atomize the liquid, said atomizer comprising:

transducer means having a plurality of laminated piezoelectric elements for converting electrical oscillation into mechanical vibration;

vibrating means connected to said transducer means and vibrating to impart vibration energy to the liquid thereby to atomize the liquid; and electrical oscillation generating means for generating resonance frequency of low DC voltage applied on said transducer means, said electrical oscillation generating means including a charging circuit for forcibly causing electric charge based on said DC resonance frequency voltage to flow from a DC power source into said laminated piezoelectric elements and a discharge circuit for forcibly causing electric charge stored in said laminated piezoelectric elements to be discharged.

2. The liquid atomizer as defined in claim 1, wherein the number of said laminated piezoelectric elements of said transducer means disposed at one side of said vibrating means is at least 20.

3. The liquid atomizer as defined in claim 1, wherein said electrical oscillation generating means includes a waveform shaping circuit for shaping a waveform of said DC resonance frequency voltage into a sine wave.

4. A liquid atomizer comprising:

at least one transducer having a plurality of laminated piezoelectric elements for converting electrical oscillation into mechanical vibration;

a tubular member connected to said transducer so that said member is caused to vibrate by said transducer, said tubular member being disposed in air including a liquid to atomize the liquid by mechanical vibration of said tubular member excited by said transducer; and a circuit for generating resonance frequency of a low DC voltage, said circuit electrically connected to said transducer and including a charging circuit for forcibly causing electric charge based on said DC resonance frequency voltage to flow from a DC power source into said laminated piezoelectric elements and a discharge circuit for forcibly causing electric charge stored in said laminated piezoelectric elements to be discharged.

5. The liquid atomizer as defined in claim 4, wherein said tubular member is connected to a pair of said transducers so that said transducers are symmetric with respect to an axis of said tubular member.

6. The liquid atomizer as defined in claim 4, wherein said tubular member is secured to said transducer by a supporting member one end of which is secured to said transducer and the other end is made thin in a perpendicular direction to the axis of said tubular member and engaged with said tubular member over substantially the entire length of said tubular member.

7. The liquid atomizer as defined in claim 4, wherein said laminated piezoelectric members each having a central hole are sandwiched by a tapered support with central hole and a flange with a hole, and secured to said tubular member by bolt nut means so that said tubular member is in contact with a small diameter portion of said support.

8. An atomized fuel supplying apparatus comprising:

an intake passage leading air to an internal combustion engine;

a fuel supplying means disposed midway of said intake passage for supplying fuel into the air flowing therein;

a tubular member provided in said intake passage around said fuel supplying means;

at least one transducer having a plurality of laminated piezoelectric elements for converting electrical oscillation into mechanical vibration, said tubular member connected to said transducer; and a DC resonance frequency voltage generating circuit including a charging circuit for forcibly causing electric charge based on said DC resonance frequency voltage to flow from a DC power source into said laminated piezoelectric elements and a discharge circuit for forcibly causing electric charge stored in said laminated piezoelectric elements to be discharged, whereby the fuel is atomized by vibration of said tubular member caused by said transducer.

9. The apparatus as defined in claim 8, wherein the total number of said laminated piezoelectric elements is at least 40.

10. The apparatus as defined in claim 8, wherein said DC resonance frequency voltage generating circuit is free of any high voltage generating coil.

* * * * *